US006413127B1

(12) United States Patent
Quaeck

(10) Patent No.: US 6,413,127 B1
(45) Date of Patent: Jul. 2, 2002

(54) LOW FRONTAL AREA, INBOARD, THROUGH-HULL PROPELLER DRIVE AND METHODS FOR ASSEMBLING AND ADJUSTING THE DRIVE

(76) Inventor: Manfred Quaeck, 1515 210$^{th}$ NE., Redmond, WA (US) 98053

( * ) Notice: Subject to any disclaimer, the term of this patent is extended or adjusted under 35 U.S.C. 154(b) by 0 days.

(21) Appl. No.: 09/883,455

(22) Filed: Jun. 18, 2001

(51) Int. Cl.$^{7}$ ..... B63H 5/125
(52) U.S. Cl. ..... 440/58; 440/53
(58) Field of Search ..... 440/53, 54, 58, 440/59, 61, 62

(56) References Cited

U.S. PATENT DOCUMENTS 2,809,605 A * 10/1957 Russell ..... 440/75

* cited by examiner

*Primary Examiner*—Ed Swinehart
(74) *Attorney, Agent, or Firm*—Robert W. Jenny

(57) ABSTRACT

The drive transfers power from an engine driven drive shaft to a propeller shaft, through the hull (not the stern) of a boat. The power is transferred by a chain and sprockets which are fully enclosed and lubricated by oil inside the drive. The tension in the chain is adjustable without disassembling the drive. The propeller shaft is carried on bearings in the main housing of the drive which is made up of a top plate, a streamlined hollow strut and the propeller shaft pod. The drive shaft is carried in a sub housing made up of top and bottom halves. The chain is installed before the top half of the sub housing and the bearings for the drive shaft are installed. This method allows for the slack and clearance (sidewise from the chain) for connecting the ends of the chain together. When the drive is fully assembled, the gap between the main and sub housing is mechanically adjustable to adjust chain tension. A sealing system seals the variable width gap to retain the oil in the drive.

17 Claims, 4 Drawing Sheets

FIG. 1
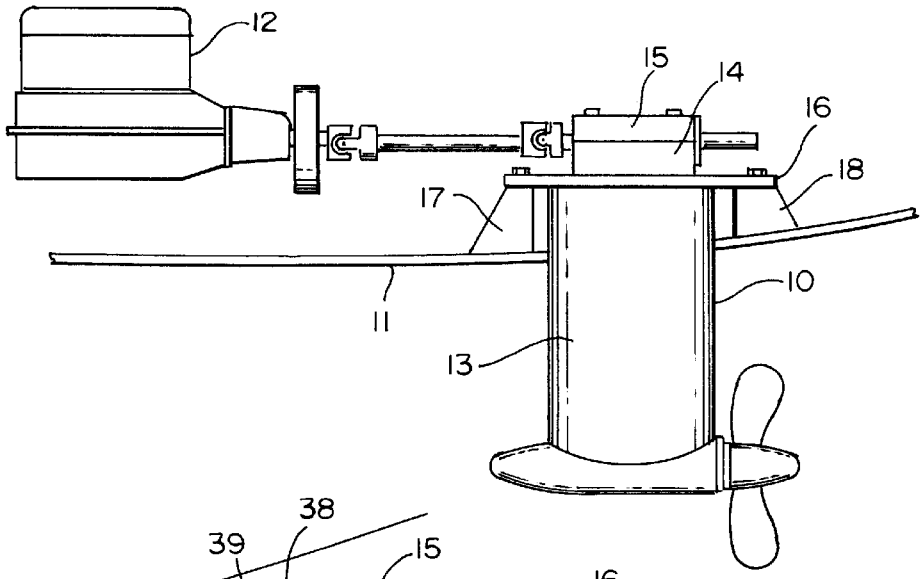
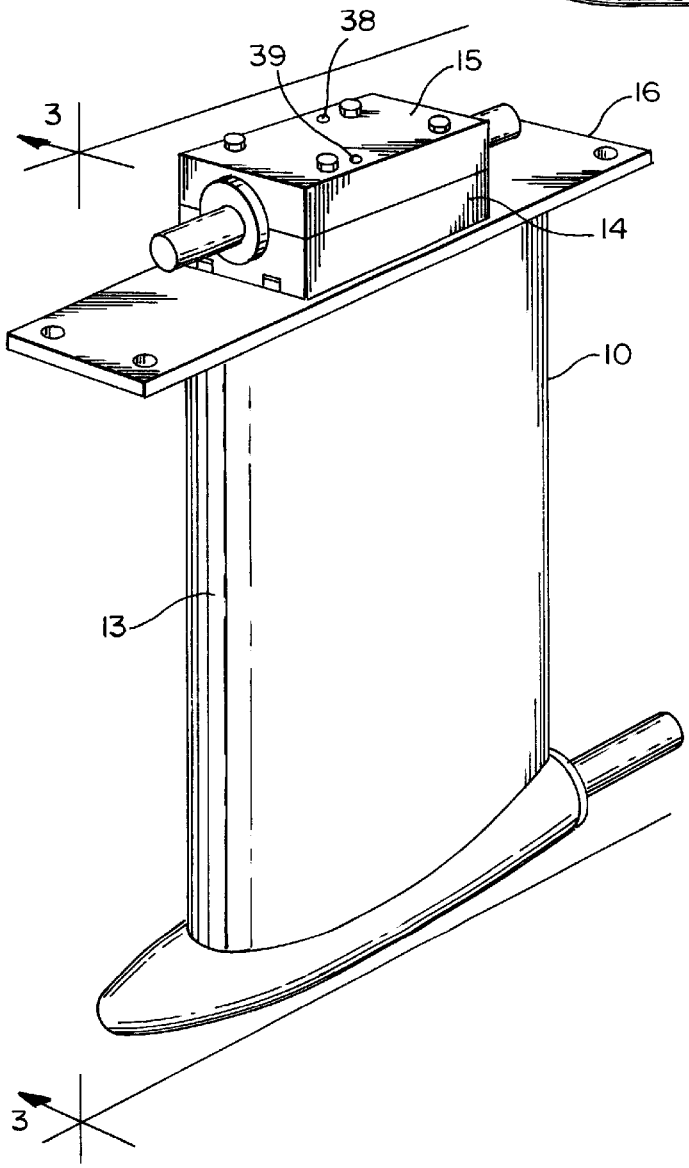
FIG. 2

35'
35''
55
53
16
74
19
26
73
52
36
15
14
54
41
40

5
5
28
33
30
22
24
21
74
31
26
26'
20'
20
25
23
32
27
29
19
35
34
73
13
16
36
40
45
51
46
50
47
49
48
42
44
41
43
37

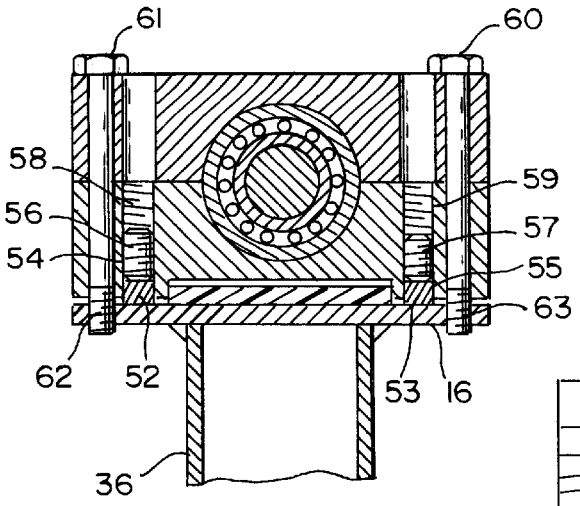
FIG. 5
FIG. 6
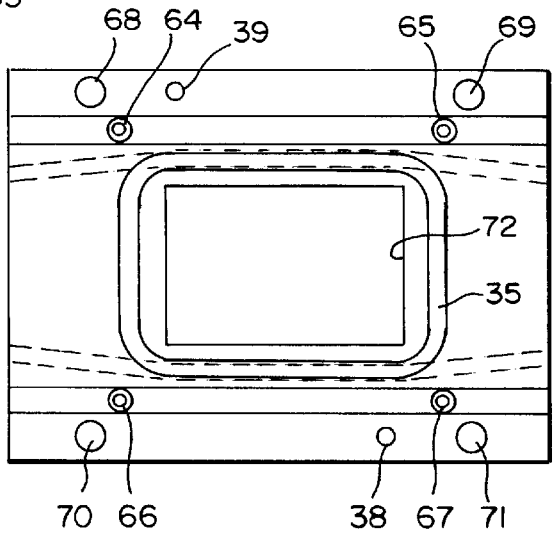
FIG. 7
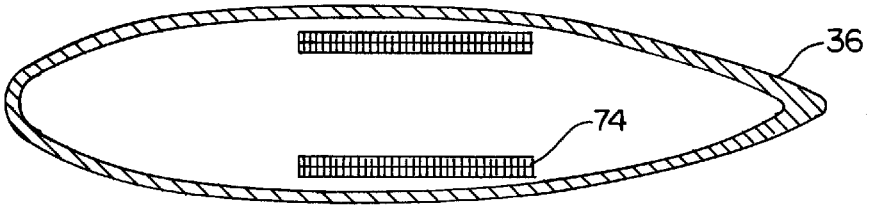
FIG. 8
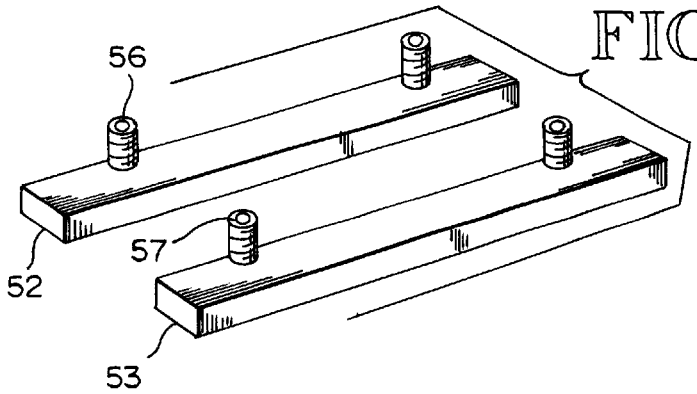

LOW FRONTAL AREA, INBOARD, THROUGH-HULL PROPELLER DRIVE AND METHODS FOR ASSEMBLING AND ADJUSTING THE DRIVE

BACKGROUND OF THE INVENTION

1. Field

The subject invention is in the field of mechanical power transmission and transfer mechanisms, particularly the field of power transfer from an engine in a boat to the propeller driven by the engine. More particularly it is in the field of such drives in which the drive shaft and propeller shaft are parallel and essentially horizontal such as in well known inboard/outboard drives in which power is transmitted through the stern of a boat above the waterline and then down to the propeller shaft and propeller. However, the subject drive is an inboard drive which transmits power through the bottom of the boat. A feature common to inboard/outboard drives and similar inboard drives is that the drive shaft and propeller shaft are parallel and power is transmitted between the two using bevel and/or miter gearing, chains or belts. One important objective of such drives is that the components in the water present as low frontal area as possible to minimize drag losses. This is particularly important for sailboats in which the propeller is an auxiliary power source and must present minimum drag when the boat is under sail. The problem is more severe for larger boats in which auxiliary power levels are in the range of 100 to 200 H.P. Since such boats are not high speed boats, propeller speeds must be relatively low and propellers fairly large to achieve satisfactory efficiency. These facts require that the torque capacity of the drive be high relative to the horsepower level. In the stated horsepower range high torque per horsepower gear drives become bulky and require undesirably large frontal areas under water and, for assembly reasons, their casings comprise several parts, in many cases having long parting lines. Chain drives are better suited to high torque per horsepower transmissions; however good operation, efficiency and long life of chain drives, particularly bi-directional drives, requires that the chains be under tension and correspondingly free of slack and running in a straight line from sprocket to sprocket. It is close to physically impossible and economically and practically impossible, using conventional techniques, to design and assemble a chain drive in which the chain is always in tension without using some sort of tensioning device. This is caused in large part by the fact that use invariably involves wearing in and wear which allow the chain(s) to go slack. Tensioning devices inherently tend to add undesirable amounts of frontal area and complication.

2. Prior Art

There is much prior art in the particular field described above and many of the prior art drives use chains. The U.S. patents listed here are typical examples:

| | |
|---|---|
| 1. 3,403,655 | 7. 4,925,413 |
| 2. 3,795,219 | 8. 4,932,907 |
| 3. 3,951,096 | 9. 4,992,066 |
| 4. 4,645,463 | 10. 5,813,887 |
| 5. 4,869,692 | 11. 5,961,358 |
| 6. 4,887,983 | |

As background to discussion of this prior art, it is important to state that the chains having the highest power capacity for their size and weight are chains known as silent chains. These chains comprise pluralities of flat links having a tooth form at each end. The side-by-side links are pinned end to end so that the teeth forms form teeth when the chain is in contact with the sprockets on which it is mounted. Belt width is determined by the numbers of links pinned side-by-side. Making and using these chains as mechanically efficiently as possible resulted in their having the characteristics that (1) they allow only limited bending in the direction away from the toothed side of the belt, and (2) the durability and efficiency depend on their being as straight as possible between sprockets at all times. These factors relate to the need for tension adjustment and prohibit techniques using tension idlers which would not allow the chain to be straight between sprockets.

Regarding the cited prior art, patents 2, 5, 6, 7, 8, 9 and 10 utilize roller chains and show no specific means for adjusting tension except in patent 9. The means shown in patent 9 comprises an oval shaped cam pivotally mounted midway between the lengths of chain between sprockets so that rotating the cam in one direction so that the cam ends contact the chain lengths spreads them apart to increase tension. This does not allow the chain in tension to be straight. Also, this means can only be used in unidirectional drives. With rotation in the wrong direction the cam would be forcefully rotated into the chain and jammed.

The remaining patents show drives using belts of some kind. Patent 1) uses a toothed belt and shows no means of adjusting tension even for the purpose of removing and installing the belt. Patent 3) also shows the use of a toothed belt with means for adjusting tension for the purpose of removing and installing the belt but none for compensating for belt stretch and other factors which are known to cause loosening of toothed belts. The means used comprise a spherically mounted bearing on one end of the drive shaft so that when the housing is disassembled and the bearing at the other end of the drive shaft is removed, the shaft can drop to an angle sufficient to allow the teeth on the belt to clear the rim on the sprocket, thus facilitating removal and replacement. The end of the shaft freed by dismantling the casing is tapered to facilitate its reentry into the bearing when the case is assembled, leveling the drive shaft again and providing nominally acceptable belt tension. However, this adjustment feature does not allow compensation for belt stretch and other factors which are known to cause belt loosening. Also, to enable replacement of this belt the casing is divided vertically into forward and aft parts, generating a need for long parting surfaces and a plurality of fasteners are needed to assemble the casing.

Patent 4) shows the use of dual toothed belts. There are no provisions for tension adjustment and the method of assembly and disassembly of the belt drive is not disclosed.

Many motorcycles transmit driving power from a drive shaft to a driven shaft, the rear axle. Chain tension is adjusted by adjusting the position of the rear axle and everything carried by it relative to the drive shaft. This technique cannot be used in propeller drives because the driven shaft must be enclosed in a housing.

In view of this prior art, the objective of the subject invention is to provide a low frontal area, inboard, through-hull propeller drive for power ranging up to 200 H.P. at maximum propeller shaft speeds of 2500 RPM, the drive using a silent chain and having (1) a housing having a minimum number of parts and short parting lines, (2) simple means for adjusting chain tension for installation and removal purposes and compensation for wear, and (3) allowing simple chain installation and removal.

SUMMARY OF THE INVENTION

The subject invention is a low frontal area, inboard, through-hull propeller drive. The drive comprises (1) a main casing having a high fineness ratio streamlined cross section shape strut and a propeller shaft, chain sprocket and bearings installed in its lower end through the opening for the propeller shaft and its bearings, (2) a sub casing attached to the upper end of the main casing, comprising upper and lower halves and having a drive shaft, sprocket and bearings installed in it, and (3) a silent chain interconnecting the sprockets which are of the same diameter. There is a plurality of chain tensioning screws in the bottom half of the sub housing which are used to adjust the distance of the sub housing from the main housing, thus adjusting chain tension. There is a sealing system in the bottom surface of the bottom half of the sub housing which seals the gap between the main and sub housings independent of the width of the gap between the two. The housing and sub housing are interconnected by a plurality of bolts.

The chain is installed with the top half of the sub housing removed. An end of the disconnected chain is passed into the main housing strut around the propeller shaft sprocket and through the main housing strut and out through its top end so that both ends of the disconnected chain are accessible. The ends of the chain are passed through a hole in the bottom of the bottom half of the sub housing and it is placed on the top of the main housing. The drive shaft with the sprocket in place is then placed in the bottom half of the sub housing with no bearings installed and the ends of the chain are connected. The absence of the top half of the sub housing allows ample accessibility for connecting the chain ends and the absence of the bearings allows ample slack in the chain for connection purposes. The chain is connected by pins as long as the width of the chain so clearance space at least equal to the width of the chain must be available off one edge of the chain. If two chains are used, clearance must be available off both outer edges. Total chain widths up to eight inches are anticipated. The bearings are then put in place, first the inner races, with the rollers and spacers and then the outer races. Two rings are then set into circumferential slots in the half bore of the bottom half of the sub housing to retain the bearings against the ends of the hub of the sprocket and to position the drive shaft and sprocket longitudinally. This procedure positions the drive shaft properly and takes up most of the slack in the chain. There are four tensioning screws in holes in the sub housing in contact with pressure bars which distribute and transfer tensioning forces to the top plate of the main housing. Turning these screws inward moves the bottom half of the sub housing away from the main housing, increasing the distance between the drive and propeller shafts and putting the chain in tension. This adjustment can be used at any time in the life of the drive to maintain adequate tension in the chain.

The top half of the sub housing is then put in place and bolts are installed through it and the bottom half to attach them to the main housing. Caps are then inserted into the ends of the bore around the drive shaft ends. The caps hold seals which prevent oil leakage around the drive shaft. A sealing system prevents leakage of the oil, with which the drive is filled, through the gap between the sub and main housings. The sealing system comprises a rectangular cross section groove in the bottom of the bottom half of the sub housing. The groove surrounds the holes for the chain in the top plate of the main housing and the bottom half of the sub housing. An elastomeric seal ring having a cross section size and shape such that it fits closely in the groove is installed in the groove. A grease fitting is installed in the bottom half of the sub housing and connected by drilled holes to the groove. Forcing grease into the groove presses the seal ring against the sides of the groove and the top plate, thus sealing the gap. This seal is re-pressurized after each adjustment of chain tension. Both ends of the drive shaft extend beyond the sub housing so that power can be applied to either end.

The plate on the top of the strut extends beyond the housing and strut to be attached to hull structure to mount the drive.

The invention is described in more detail below with reference to the attached drawings.

BRIEF DESCRIPTION OF THE DRAWINGS

FIG. 1 is a schematic side view of the subject drive installed in the hull of a boat.

FIG. 2 is a general view of the subject drive.

FIG. 5 is a section taken at 5—5 in FIG. 3.

FIG. 6 is a bottom view of the lower half of the sub housing.

FIG. 7 is a section taken at 7—7 in FIG. 3.

FIG. 8 is a schematic exploded diagram of the described apparatus for adjusting the gap between the sub housing and main housing.

DETAILED DESCRIPTION OF THE INVENTION

Figures 3, 4:
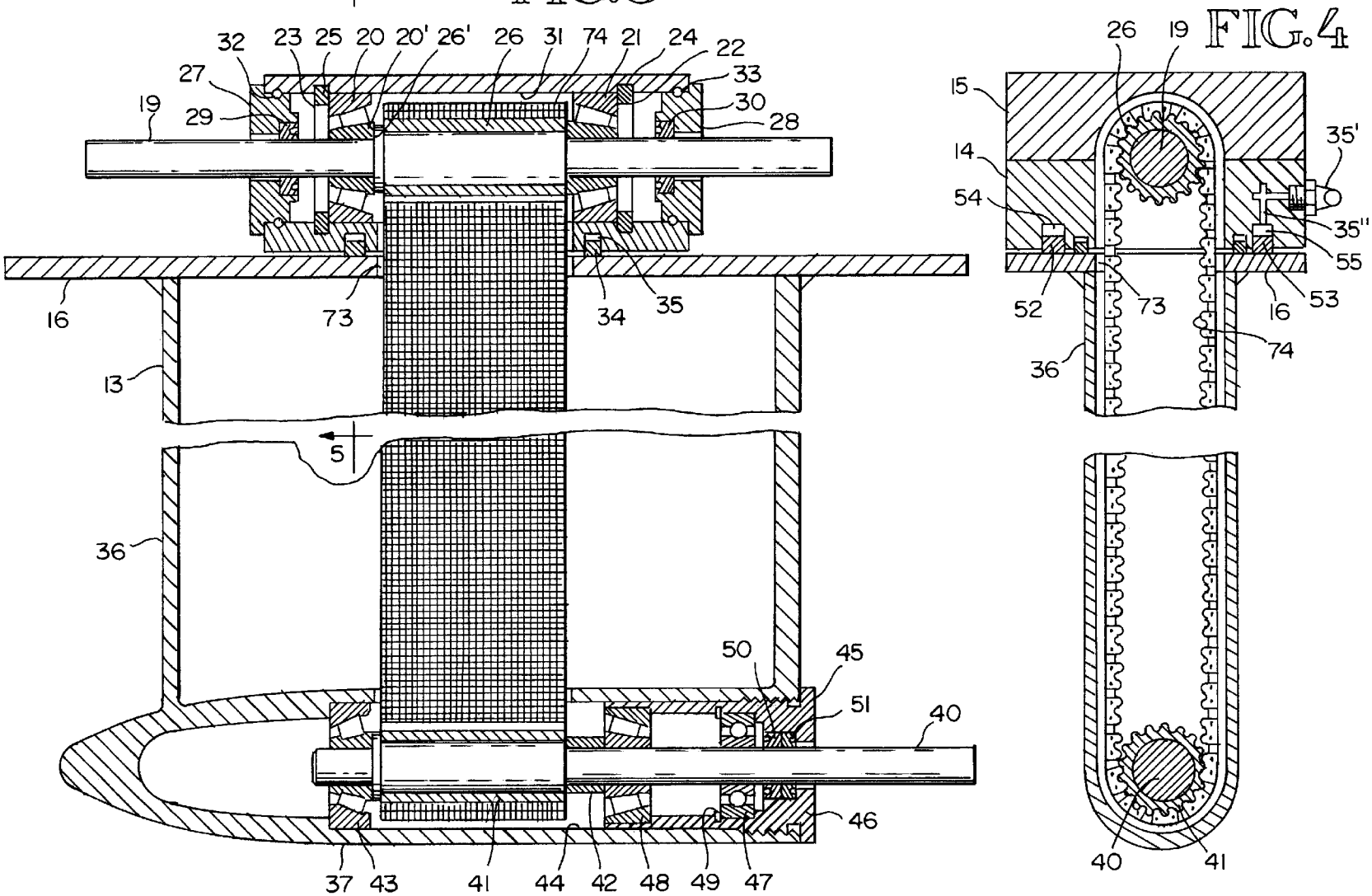
FIG. 3 is a section taken at 3—3 in FIG. 2.
FIG. 4 is a section taken at 4—4 in FIG. 3.

The subject invention is a low frontal area, inboard, through-hull propeller drive. In FIG. 1 drive 10 is schematically shown installed in boat hull 11. Showing in this view are engine 12, main housing 13, sub housing bottom half 14 and sub housing top half 15. FIG. 2 is a general view of the subject drive, with parts numbered as in FIG. 1. Top plate 16 of the main housing extends over and is attached to structures 17 and 18 to mount the drive.

FIG. 3 is a section taken at 3—3 in FIG. 2. Drive shaft 19 is carried in tapered roller bearings 20 and 21 in the sub housing. Rings 22 and 23 in grooves 24 and 25 position the bearings, drive shaft and sprocket 26 on the drive shaft in position longitudinally. Flange 26' facilitates installation of inner race 20' of bearing 20 and the sprocket on the shaft. Caps 27 and 28 carry seals 29 and 30 respectively and are snapped into place in the ends of bore 31 and held in place by O-rings 32 and 33. Elastomeric sealing ring 34 in groove 35 seals the gap between the sub housing and main housing. Groove 35 is pressurized with grease to maintain the seal despite changes in gap width associated with adjustment of chain tension as explained in the Summary Of The Invention. In FIG. 4, a grease fitting 35' mounted in part 14 is connected by drilled passage 35' to groove 35 and the groove is pressurized after every chain tension adjustment.

Main housing 13 comprises strut 36, top plate 16 and propeller shaft pod 37, attached by welding or brazing, depending on selection of materials. The strut and pod may be fabricated as one piece. Dowell pins 38 and 39, shown in FIGS. 2 and 7, extend through the top and bottom halves of the sub housing and into the top plate to assure alignment of these parts. They may also extend through pressure bars which are shown in FIGS. 2, 4 and 5 and explained below. Propeller shaft 40 with sprocket 41 and spacer 42 are inserted into bearing 43 in bore 44 and then cartridge assembly 45 is installed to complete the installation of the propeller shaft. Flange 40' facilitates installation of inner bearing race 43' and the sprocket on the shaft. Cartridge assembly 45 comprises cartridge 46, bearing 47, bearing 48, snap ring 49 and seals 50 and 51. Seal 50 seals oil in the drive. Seal 51 seals seawater out.

FIG. 4 is a section taken at 4—4 in FIG. 3, with parts numbered as in previous FIGS. Pressure bars 52 and 53 in grooves 54 and 55, also shown in FIG. 6, carry and distribute forces applied by four tension adjustment screws in the bottom half of the sub housing to the top plate of the main housing. These forces tension the chain. Tension adjustment screws 56 and 57 in holes 58 and 59 in the bottom half of the sub housing are shown in FIG. 5, a section taken at 5—5 in FIG. 3. Also shown in FIG. 5 are two of the four bolts which attach the two halves of the sub housing and the main housing together, bolts 60 and 61 engaging tapped holes 62 and 63 in the top plate. One possible set of locations of the four bolt holes and four tension adjustment screws is shown in FIG. 6, a bottom view of the lower half of the sub housing. Holes 64, 65, 66 and 67 are tension adjustment screw holes a hole 73 in the top plate, see FIGS. 3 and 4, which matches hole 72. The dashed lines show the profile of the strut relative to holes 72 and 73. Chain 74 interconnects the sprockets.

FIG. 7 is a section taken at 7—7 in FIG. 3 and illustrates the high fineness ratio, streamlined shape of the strut, parts being numbered as in other FIGS.

FIG. 8 is a schematic exploded sketch of the tension adjustment screws, screws 56 and 57 being typical, and the pressure bars 52 and 53 as described for adjusting the gap between the sub housing and main housing, thus adjusting chain tension.

Figure 9:
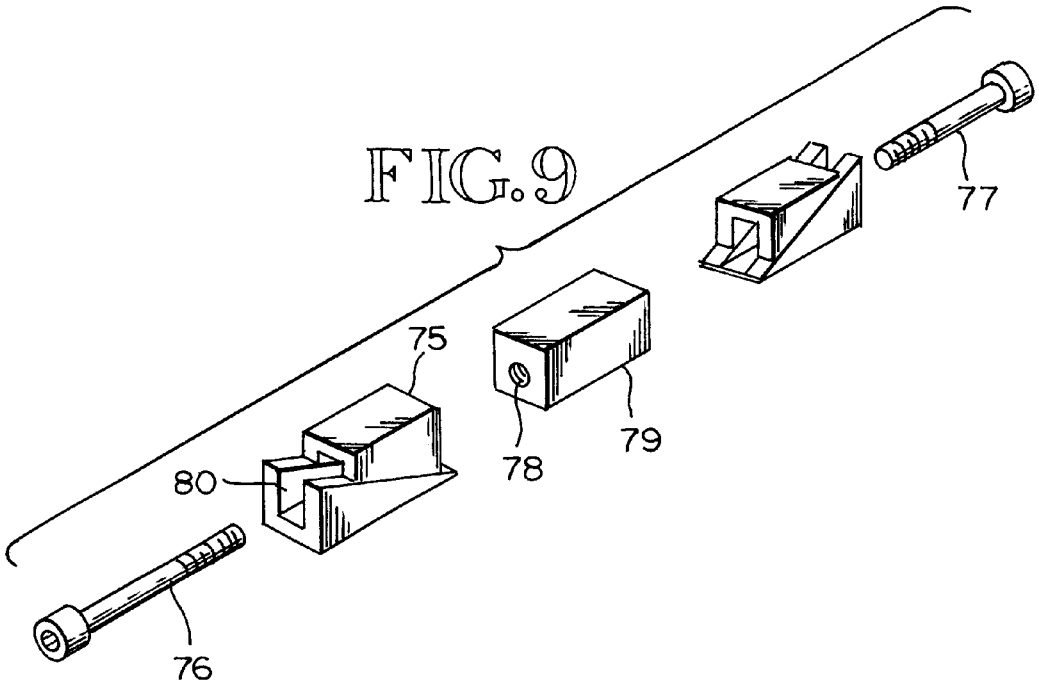
FIG. 9 is a schematic exploded diagram of an alternate apparatus for adjusting the gap between the sub housing and main housing.

FIG. 9 is a schematic exploded sketch of alternate mechanism for making that adjustment. The mechanism is in two sets installed in grooves in the bottom of the bottom half of the sub housing. The four wedges, wedge 75 being typical, are adjusted longitudinally by bolts 76 and 77 which are anchored in threaded hole 78 in block 79. The bolts fit in grooves in the wedges, groove 80 being typical. Tightening the bolts forces the wedges to slide up on each other, increasing the gap and vice versa.

Figure 10:
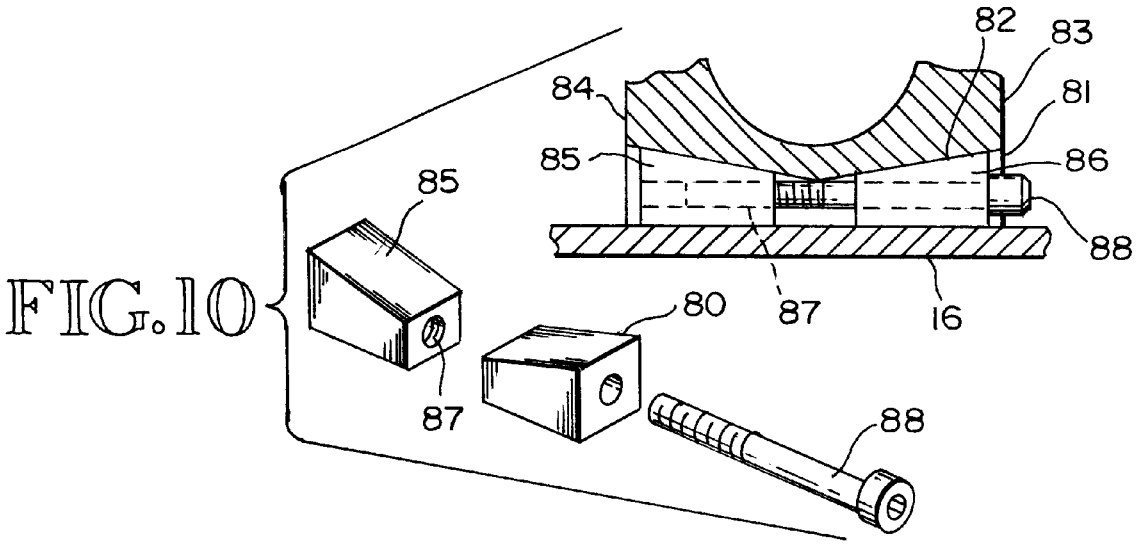
FIG. 10 is a schematic section of the bottom half of the sub housing and illustrates another mechanism for adjusting the gap between the sub housing and main housing, thus adjusting chain tension.

FIG. 10 is a schematic section of the lower half of the sub housing and mechanism for adjusting the gap between the main and sub housing, thus adjusting the chain tension. There are two transverse grooves in the bottom of the bottom half, groove 81 being typical. The bottoms of the grooves (upper surfaces in this view, bottom 82 being typical) slope inward from edges 83 and 84 to the center with the grooves being shallowest at the center. Two wedges are installed in each groove, wedges 85 and 86 being typical. There is a threaded hole 87 in one of each pair of wedges and a hole in the other. Bolts, bolt 88 being typical, are installed through the hole in one wedge and engage the threaded hole in the other. Tightening the bolts pulls the wedges toward each other and increases the gap between the bottom half of the sub housing and the top plate 16 of the main housing and vice versa.

It is considered to be understandable from this description that the subject invention meets its objective. It provides a low frontal area, inboard, through hull propeller drive capable of transmitting at least up to 200 horsepower at propeller shaft speeds in the range of 2200 to 2700 RPM. This capability is provided by use of a silent chain. The drive is simple, having a four-part housing with short horizontal parting lines. Chain tension adjustment is simple for installation and removal purposes and for compensating for wear. Also, chain installation and removal procedures are simple and straightforward.

The subject drive is a chain drive which is fully enclosed and sealed in the main and sub housing and chain tension is adjustable with no disassembly.

It is also considered to be understood that while one embodiment of the invention is disclosed herein, other embodiments and modifications of the one disclosed are possible within the scope of the invention which is limited only by the attached claims.

I claim:

1. A through-hull propeller drive comprising a) a main housing, having a top plate, b) a sub housing comprising a top half and a bottom half, c) at least two first bearings, d) two second bearings, e) a drive shaft, f) a propeller shaft, g) a first sprocket, h) a second sprocket, i) a silent chain which is connectable and disconnectable and has first and second ends, j) means for adjustably attaching said sub housing to said main housing with a distance between said bottom half of said sub housing and said main housing and such that said distance is adjustable and a gap is created, said gap having a width which is adjusted when said means for adjustably attaching are used, and k) adjustable means for sealing said gap, said propeller shaft being installed in said main housing on said at least two first bearings, said drive shaft being installed in said sub housing on said two second bearings, said first sprocket being mounted on said drive shaft, said second sprocket being mounted on said propeller shaft, said sprockets being interconnected by said silent chain whereby said means for adjustably attaching adjusts said distance and adjusts tension in said chain.

2. The drive of claim 1 in which said bottom half of said sub housing has a first hole for said silent chain and said top plate has a second hole for said chain, said drive being assembled by a method comprising the steps of:

a) installing said second sprocket on said propeller shaft, b) installing said propeller shaft and said second sprocket in said main housing using said at least two first bearings, c) disconnecting said chain, d) inserting said first end through said hole in said top plate, through said main housing to said second sprocket, around said second sprocket and out of said main housing through said second hole, whereby said first and second ends are accessible for reconnection, e) installing said first sprocket on said drive shaft, f) inserting said first and second ends of said chain through said first hole in said bottom half of said sub housing, g) placing said sub housing onto said top plate with said first and second holes aligned, h) placing said drive shaft and said first sprocket in said bottom half of said sub housing, i) connecting said first and second ends of said chain around said first sprocket, j) installing said two second bearings on said drive shaft in said bottom half of said sub housing, k) using said means for adjustably attaching to apply tension to said chain and attach said top half of said sub housing to said bottom half of said sub housing and to said top plate of said main housing, and l) adjusting said adjustable means for sealing.

3. The drive of claim 1 in which said means for adjustably attaching said sub housing to said main housing comprises means for attaching said sub housing to said main housing and pulling the two toward each other and means for moving the sub housing and main housing apart, said means for attaching and pulling comprising:

a) a plurality of threaded holes in said top plate, b) a first plurality of holes through said sub housing perpendicular to said bottom of said bottom half of said sub housing, and c) a plurality of bolts, said plurality of bolts being inserted through said plurality of holes and engaging said plurality of threaded holes, said means for moving said sub housing and said main housing apart comprising:

a) a plurality of threaded holes in said bottom half of said sub housing perpendicular to said bottom of said bottom half, b) a plurality of tensioning screws, said plurality of tensioning screws being installed in said plurality of threaded holes and contacting said top plate of said main housing such that tightening said plurality of tensioning screws moves said sub housing away from said main housing and vice versa.

4. The drive of claim 3 further having a second plurality of holes through said top half of said sub housing, said second plurality of holes being aligned with said plurality of threaded holes in said bottom half of said sub housing and providing access to said plurality of tensioning screws.

5. The drive of claim 4 in which the method of adjusting said distances comprises the steps of:

a) loosening said plurality of bolts if necessary, b) adjusting said plurality of tensioning screws and c) tightening said plurality of bolts.

6. The drive of claim 3 further comprising a plurality of pressure bars installed between said plurality of tensioning screws and said top plate.

7. The drive of claim 4 further comprising a plurality of pressure bars installed between said plurality of tensioning screws and said top plate.

8. The drive of claim 5 further comprising a plurality of pressure bars installed between said plurality of tensioning screws and said top plate.

9. The drive of claim 3 in which said means for moving said sub housing and said main housing apart comprises:

a) a plurality of parts having interacting inclined surfaces and means for causing said parts having inclined surfaces to interact.

10. The drive of claim 9 in which adjusting said distance between said sub housing and said housing comprises the steps of:

a) loosening said plurality of bolts if necessary, b) causing said plurality of parts having inclined surfaces to interact, and c) tightening said plurality of bolts.

11. The drive of claim 1 in which adjustable means for sealing said gap comprises:

a) an elastomeric sealing ring, b) a groove in said bottom of said bottom half of said sub housing, said groove surrounding said first hole, said sealing ring being installed in said groove, c) means for pressurizing said groove.

12. The drive of claim 3 in which adjustable means for sealing said gap comprises:

a) an elastomeric sealing ring, b) a groove in said bottom of said bottom half of said sub housing, said groove surrounding said first hole, said sealing ring being installed in said groove, c) means for pressurizing said groove.

13. The drive of claim 4 in which adjustable means for sealing said gap comprises:

a) an elastomeric sealing ring, b) a groove in said bottom of said bottom half of said sub housing, said groove surrounding said first hole, said sealing ring being installed in said groove, c) means for pressurizing said groove.

14. The drive of claim 6 in which adjustable means for sealing said gap comprises:

a) an elastomeric sealing ring, b) a groove in said bottom of said bottom half of said sub housing, said groove surrounding said first hole, said sealing ring being installed in said groove, c) means for pressurizing said groove.

15. The drive of claim 7 in which adjustable means for sealing said gap comprises:

a) an elastomeric sealing ring, b) a groove in said bottom of said bottom half of said sub housing, said groove surrounding said first hole, said sealing ring being installed in said groove, c) means for pressurizing said groove.

16. The drive of claim 8 in which adjustable means for sealing said gap comprises:

a) an elastomeric sealing ring, b) a groove in said bottom of said bottom half of said sub housing, said groove surrounding said first hole, said sealing ring being installed in said groove, c) means for pressurizing said groove.

17. A propeller drive comprising:

a main housing, a sub housing, a chain, two sprockets, a drive shaft, a propeller shaft, a quantity of oil, said drive shaft, propeller shaft, chain and two sprockets being installed in said main and sub housings, said main and sub housings having a gap between them, said main housing and said sub housing being filled with said quantity of oil, said drive further comprising means for sealing said gap to prevent leakage of said oil through said gap, said gap being sealed by said means for sealing, said chain being operable under tension, said drive further comprising means for adjusting said tension without disassembly of any of said drive.

* * * * *